US005165480A

United States Patent [19]

Wagoner et al.

[11] Patent Number: 5,165,480

[45] Date of Patent: Nov. 24, 1992

[54] METHOD AND APPARATUS OF LOCKING CLOSED A SUBSURFACE SAFETY SYSTEM

[75] Inventors: Danny W. Wagoner, Sugarland; David L. Parker, Seabrook; Arthur J. Morris, Magnolia, all of Tex.

[73] Assignee: Camco International Inc., Houston, Tex.

[21] Appl. No.: 738,994

[22] Filed: Aug. 1, 1991

[51] Int. Cl.[5] ..... E21B 34/10; E21B 34/14; E21B 43/12

[52] U.S. Cl. ..... 166/375; 166/117.5; 166/332; 166/385

[58] Field of Search ..... 166/375, 374, 323, 332, 166/66.4, 386, 385, 117.5

[56] References Cited

U.S. PATENT DOCUMENTS

| | | | |
|---|---|---|---|
| 3,741,299 | 6/1973 | Terral | 166/117.5 |
| 3,786,867 | 1/1974 | Tausch et al. | 166/375 |
| 4,161,219 | 7/1979 | Pringle | 166/324 |
| 4,469,179 | 9/1984 | Crow et al. | 116/323 X |
| 4,566,534 | 1/1986 | Going, III | 166/66.4 |
| 4,649,993 | 3/1987 | Going, III | 166/66.4 X |
| 4,802,147 | 4/1988 | Wolff et al. | 166/375 |

*Primary Examiner*—Stephen J. Novosad
*Attorney, Agent, or Firm*—Fulbright & Jaworski

[57] ABSTRACT

Locking closed a subsurface safety system in a well production tubing from the well surface by releasably holding the subsurface safety valve in the open position. Thereafter closing the subsurface safety system from the well surface through a control line extending exteriorly of the production tubing. Thereafter preventing the safety system from being opened through the control line.

9 Claims, 3 Drawing Sheets

METHOD AND APPARATUS OF LOCKING CLOSED A SUBSURFACE SAFETY SYSTEM

BACKGROUND OF THE INVENTION

The present invention is directed to a method and apparatus for providing a locked closed subsurface safety system for protecting petroleum reserves from undesired intervention and/or sabotage.

It is the practice of most safety systems to feature the ability to apply hydraulic pressure or electrical current through a control line to open a downhole safety valve for well production and upon release of this system the valve will close, ceasing all production of any well fluids. However, this very procedure provides the means by which a saboteur could hydraulically or electrically lock open the safety valve from the surface before setting fire to a free flowing well. And in wells where no safety systems exist the well will usually end up burning itself out when the fuel feeding the fire is depleted or until appropriate extinguishing techniques have been applied.

Therefore, the present invention is directed to a surface controlled locked closed subsurface safety system which will close a downhole safety valve and prevent the valve from being reopened through the control line. The valve can only be reopened by conventional wireline procedures which require moving a rig onto location and opening the valve through the interior bore of the production tubing, which requires considerable time and effort. Thus, the present invention protects petroleum reserves from undesired intervention and/or sabotage.

SUMMARY

The present invention is directed to a method of locking closed a subsurface safety system in a well production tubing by actuation from the well surface. The method includes releasably holding the subsurface safety valve in the open position allowing well production through the production tubing. The method also includes closing the subsurface safety valve from the well surface through a control line extending from the safety system to the well surface exteriorly of the bore of the production tubing, and preventing the safety system from being opened through the control line.

In one form of the invention, the control line is a hydraulic control line and the method includes the step of venting the hydraulic control line at a subsurface location.

In still another embodiment of the invention, the method includes the step of preventing the safety system from being opened including mechanically locking the safety system in the closed position inside the production tubing.

Still a further object of the present invention is the provision of a surface controlled locked closed subsurface safety system which includes a subsurface safety system in a well production tubing controlling the flow of well fluids through the tubing. A control line extends from the well surface to the safety system exteriorly of the production tubing for controlling the opening and closing the safety system. Subsurface means are provided connected to the control line and actuated by the control line for preventing the safety system from being opened by the control line. In one embodiment the system includes a hydraulically actuated subsurface safety valve actuated through a hydraulic control line and includes a normally closed vent means connected to the control line. The vent means is actuated to the open position venting the control line upon the actuation by a higher hydraulic pressure in the control line than required for actuation of the safety valve.

In one embodiment the system includes a hydraulically actuated subsurface safety valve positioned in the production tubing, a hydraulic control line connected to the safety valve, a sidepocket mandrel connected in the production tubing above the safety valve, and a normally closed valve positioned in the sidepocket mandrel and connected to the control line and actuated to an open position venting the control line upon the application of a predetermined pressure in the control line.

Still a further object of the present invention is the provision of a subsurface well safety valve including a housing having a bore therethrough, a valve closure member in the bore moving between open and closed positions for controlling the fluid flow through the bore, a flow tube telescopically movable in the housing for controlling the movement of the valve closure member, and biasing means in the housing urging the flow tube in a direction to close the valve. Releasable latch means are provided in the housing releasably holding the flow tube in a position holding the valve in the open position. Actuating means in the housing is adapted to be connected to a control line extending to the well surface and said actuating means is engagable with the releasable latch means for releasing the flow tube and closing the valve. In one form of the invention the actuating means is a hydraulic piston and cylinder assembly.

The releasable latch means may include dog means engaging and preventing movement of the flow tube with shoulder means releasably holding the dogs in engagement with the flow tube. Spring means yieldably acts on the shoulder means.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

While the present invention in a surface controlled lock closed subsurface safety system will be described, for purposes of illustration only, as using a hydraulically actuated flapper type safety valve, it will be understood that the present invention may be used with other types of safety valves, safety valves having other types of valve closure elements, and electrically actuated solenoid valves as well as hydraulically controlled valves.

Figure 1:
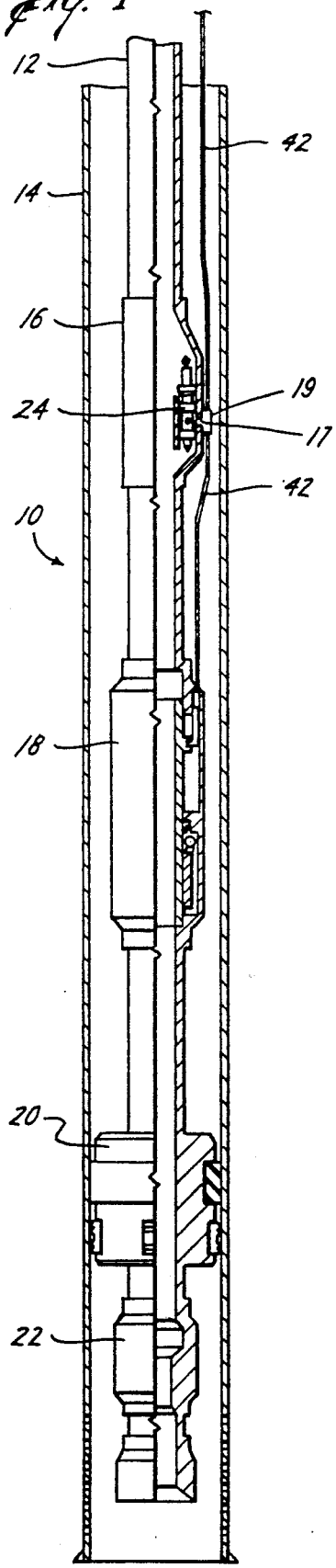
FIG. 1 is an elevational view, partly in cross section, of one form of the present invention.

Referring now to the drawings, and particularly to FIG. 1, the reference numeral 10, generally indicates a subsurface safety system according to the present invention which is installed in the well production tubing 12 through which well production flows from the well to the well surface and which is enclosed in the normal well casing 14. The present safety system 10 is installed in the tubing and generally includes a sidepocket mandrel 16 with a vent valve 24, and a hydraulically controlled well safety valve 18. The installation may also include other components which form no part of the present invention, such as a packer 20, and landing nipple 22.

Figure 2A:
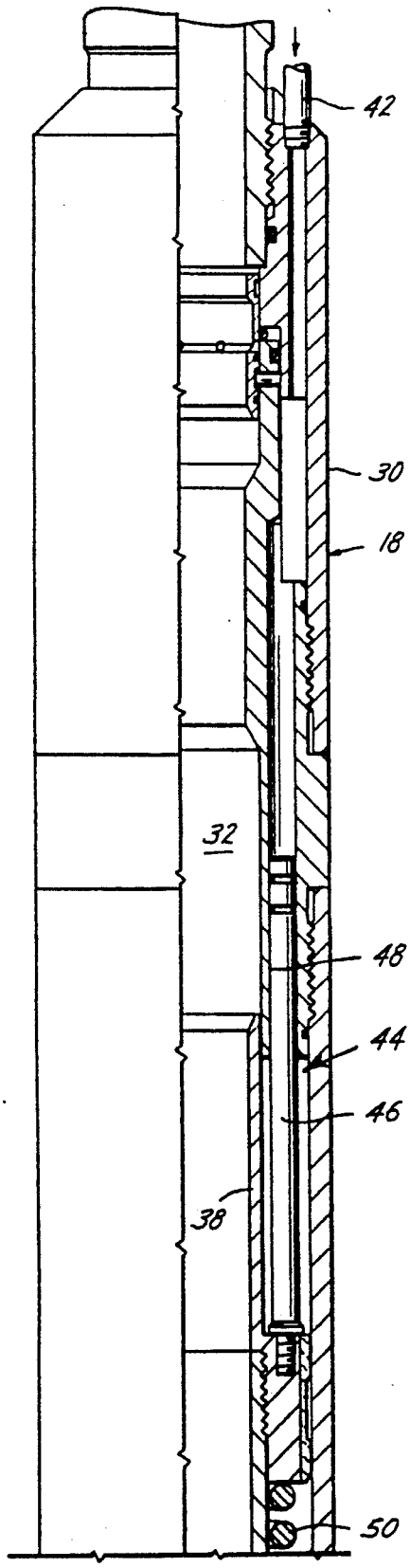
FIGS. 2A and 2B are continuations of each other of a fragmentary elevational view, partly in cross section, of one suitable type of hydraulically actuated well safety valve for use in the system of FIG. 1.
Figure 2B:
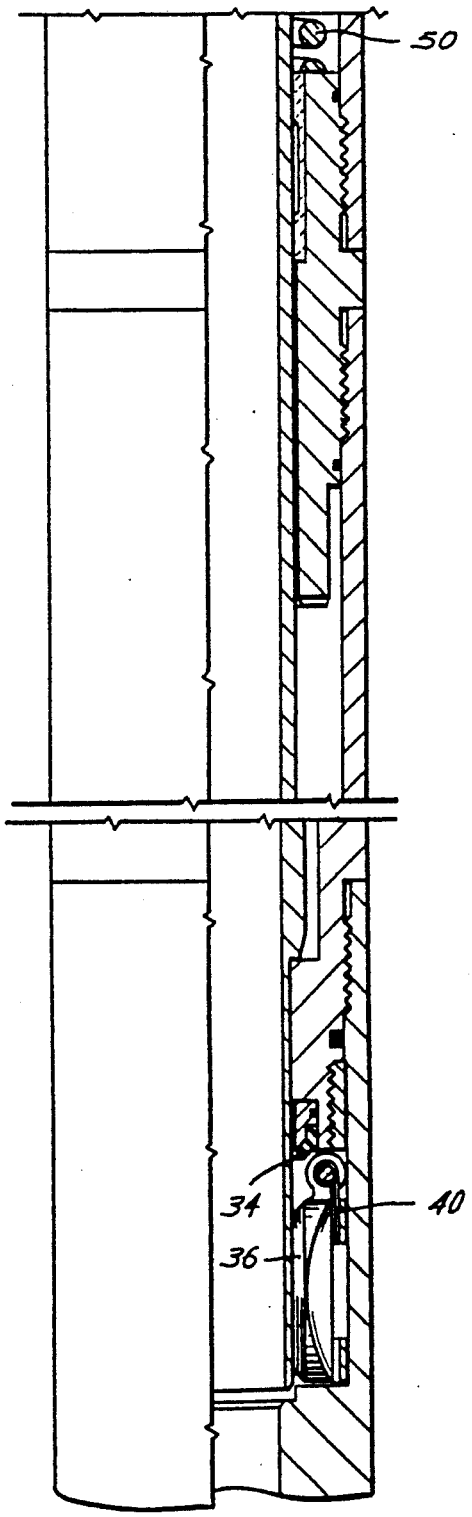

The safety valve 18 may be of any suitable hydraulic controlled, or electrically controlled, subsurface well safety valve. For example, the valve 18 may be a Camco TRDP safety valve or other conventional safety valves. A suitable safety valve 18, such as described in U.S. Pat. No. 4,161,219, is shown in FIGS. 2A and 2B and generally includes a housing 30 having a bore 32 therethrough, an annular valve seat 34, a valve closure element 36 adapted to seat on the seat 34. A flow tube 38 is telescopically movable in the body 30 and through the valve seat 34. When the flow tube 38 moves to a downward position, it pushes the valve element 36 away from the valve seat, as best seen in FIG. 2B, and the valve is held in the open position so long as the tube 38 is in the downward position. When the flow tube 38 is moved to the upward position, the valve closure element 36 closes and seats on the seat 34 by action of a spring 40. The valve 18 is closed by the application or removal of hydraulic fluid through a control line 42 leading to the well surface. The hydraulic fluid acts on a piston and cylinder assembly generally, here shown as one assembly, indicated by the reference numeral 44, which includes a piston 46 movable in a cylinder 48. The assembly 44 engages the flow tube 38 for actuating the valve 18. Power spring 50 provides biasing means for biasing the valve to the closed position. A further description of a suitable valve can be found in U.S. Pat. No. 4,161,219, which is incorporated herein by reference.

In conventionally operating safety valves, such as safety valve 18, hydraulic pressure is applied through the control line 42 to open the safety valve 18 for allowing well production therethrough and upon release of the hydraulic pressure in the line 42, the valve 18 will close shutting off all production of any well fluids. However, this very procedure which provides the means by which the safety valve 18 can be controlled from the well surface, makes the safety valve 18 susceptible to being deliberately held open for setting fire to a free flowing well.

The present invention is directed to additionally providing a surface controlled lock closed feature which will provide the necessary equipment to close the downhole safety valve 18 from the control line 42, but prevent the valve 18 from being reopened except through intervention through the interior of the production tubing 12.

Figure 3:
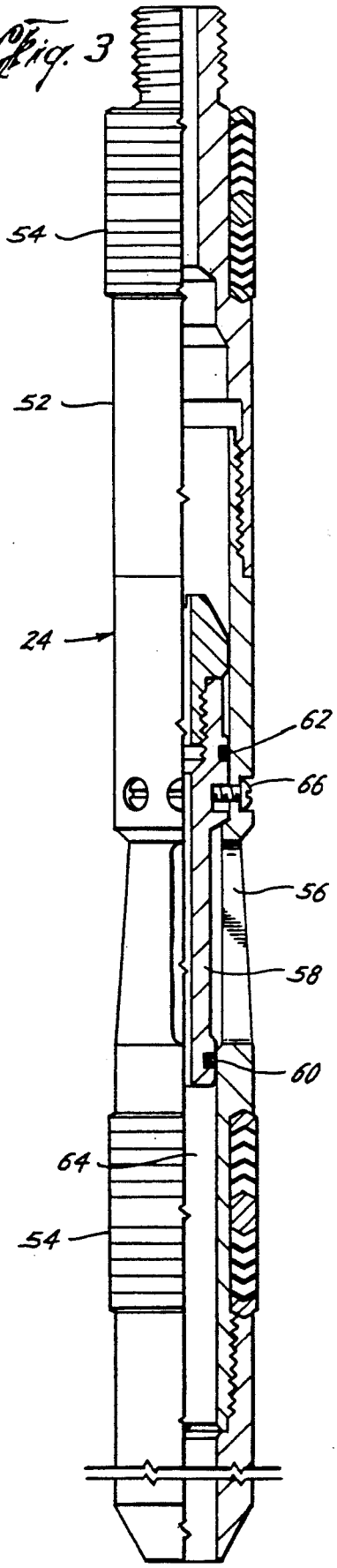
FIG. 3 is an enlarged elevational view, partly in cross section, of one suitable valve for use in the sidepocket mandrel of FIG. 1.

However, the present safety system 10 prevents the safety valve 18 from being opened through the control line 42. Referring again to FIG. 1, a conventional sidepocket mandrel 16 is provided. While any suitable sidepocket mandrel can be used, one described more fully in U.S. Pat. No. 3,741,299 may be used having a sidepocket in which a control valve, such as the vent valve 24, may be installed and removed therein. One suitable type of valve is a conventional Camco DCK dump-kill valve and latch, which is conventional, but for purposes of full disclosure is shown in FIG. 3. Referring now to FIG. 3, the vent valve 24 includes a body 52 having upper and lower packing seals 54 for seating in the sidepocket of the mandrel 16 and sealing across openings 17 (FIG. 1) between the sidepocket and the exterior of the mandrel 16. A port 56 in the housing is in communication with the openings 17 in the mandrel 16 which in turn are connected by a T connection 19 to the control line 42. Thus, hydraulic control fluid in the control line 42 is in communication with the port 56. Normally a piston 58 defined by seals 60 and 62 block communication of the port 56 from an interior bore 64 of the valve 24, which in turn is in communication with the bore of the mandrel 16 and bore of the production tubing 12. The piston 58 is held in a locked position by one or more shear screws 66. However, when the hydraulic pressure in the control line 42 is increased to a predetermined value, which is above the operating pressure of the safety valve 18, the shear pins 66 are sheared, the piston 58 moves upwardly allowing hydraulic control fluid in the control line 42 to vent itself through the port 56 and into the interior of the production tubing 12. Venting of the hydraulic control fluid from the line 42 prevents pressurizing the line to keep the safety valve 18 open, and instead the safety valve 18 by having pressure to its piston and cylinder assembly 44 vented, causes the valve 18 to close.

Therefore, in the event that it becomes necessary to lock closed the safety valve 18, a predetermined pressure above the opening pressure of the safety valve 18 is applied to the hydraulic control line 42. The vent valve 24 will then actuate and dump and vent the hydraulic pressure in the line 42 in the control line thus disabling any pressure communication to the valve 18. The valve 18 is now said to be locked closed. Hydraulic pressure cannot reopen the valve. In order to place the safety valve back in operation, the dump-kill valve 24 may be retrieved from the sidepocket mandrel and reset conventionally using conventional wireline methods and tools. Once the valve 24 has been repinned, it may be run back into the mandrel 16, re-establishing the hydraulic circuit in order to operate the subsurface safety valve 18. However, it is to be noted that resetting the safety system 10 requires the use of a rig and wireline tools and operators and thus cannot be quickly accomplished and therefore is a great discouragement to any would-be saboteurs.

Therefore, the safety system 10 is fail-safe, the lockout valve 18 cannot be reopened by pressure through the control line 42 from the well surface and therefore provides enhanced protection of the well reservoir from sabotage or unwanted intervention.

Figure 4:
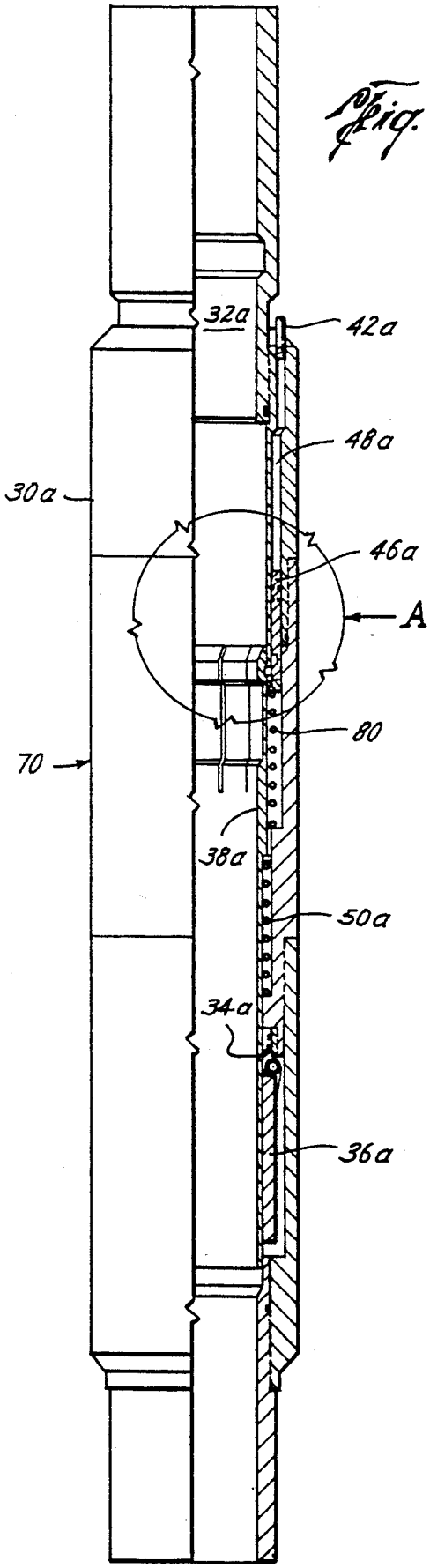
FIG. 4 is a fragmentary elevational view, partly in cross section, of another embodiment of the present invention.
Figure 5:
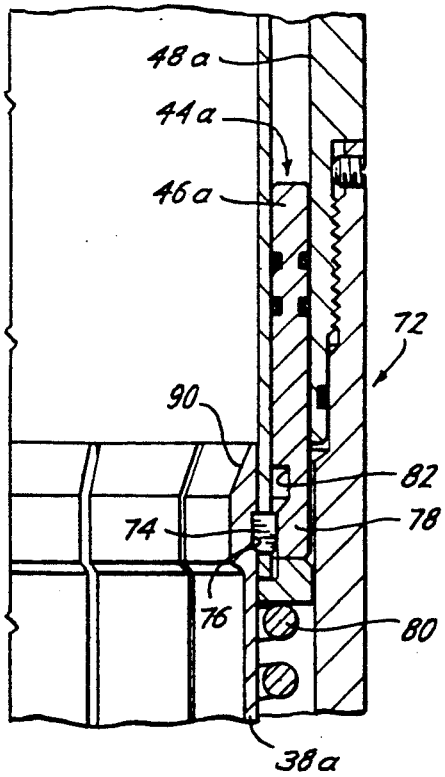
FIG. 5 is an enlarged elevational view of the circled detail A of FIG. 4.

Other and further embodiments of the present invention may be provided as best seen in FIGS. 4 and 5 wherein like parts to those described in connection with FIGS. 1-3 are provided with similar numbers with the addition of suffix "a". In some petroleum wells there are no safety systems such as a hydraulic or solenoid type well safety valve 18 which can be controlled through a control line to the well surface. Therefore, a special safety valve generally indicated by the reference numeral 70 is disclosed for insertion in the production tubing 12 in order to prevent sabotage and to meet the needs of a lock closed system. The valve 70 is a normally open valve but can be activated as disclosed by hydraulic pressure, or an electrically actuated solenoid, to close the valve through a control line 42*a* and prevent its reopening through the control line 42*a*. The valve 70 includes a housing 30*a* having a bore 32*a* therethrough, a valve closure element 36*a* adapted to seat on a valve seat 34*a* and which is held in the open position by a flow tube 38*a*. Spring biasing means 50*a* act in a direction to yieldably urge the flow tube 38*a* to a position allowing the valve 70 to close. However, the flow tube 38*a* is held in the open position by a releasable latch means in the housing 30*a* generally indicated by the reference numeral 72. The latch means may include a plurality of dogs 74 engaging a holding notch 76 in the flow tube 38*a* with shoulder means 78 releasably holding the dogs 74 in the notch 76 and with spring means 80 yieldably acting to retain the shoulder means 78 in its holding position.

Actuating means are provided in the housing 30*a* such as an electrically actuated solenoid or as here shown a piston and cylinder assembly 44*a*, which is hydraulically actuated through a control line 42*a* leading to the well surface. The assembly 44*a* includes a piston 46*a* movable in a cylinder 48*a*. Application of a predetermined hydraulic pressure in the line 42*a* actuates the piston 46*a* to engage and move the shoulder 78 downwardly overcoming the spring means 80 until the dogs 74 are aligned with a recess 82 above the shoulder 78. This allows the dogs 74 to move into the recess 82 and out of the holding notch 76 in the flow tube 38*a* which frees the flow tube 38*a* for upward movement by the biasing spring 50*a*. Upward movement of the flow tube 38*a* out of the way of the valve closure member 36*a* allows the valve 70 to close. After closure, the valve 70 cannot be reactivated through the control line 42*a* leading to the well surface.

The flow tube 38*a* includes a resetting shoulder 90. In order to place the safety valve 70 back into operation after actuation by hydraulic fluid applied through the control line 42*a*, a conventional wireline tool is used to be inserted into the bore 32*a* of the valve 70. The tool engages the resetting shoulder 90 and shifts the flow tube 38*a* downwardly which rotates the flapper valve element 36*a* to the open position. Once the locking notch 76 moves and becomes aligned with the dogs 74, the power spring 80 moves the locking shoulder 78 upwardly to hold the dogs 74 in the locked position.

The valve 70 may be used in conjunction with the subsurface safety system 10 of FIG. 1 in place of the mandrel 16 and valve 24 provided that the power spring force of spring 80 exceeds the force it takes to open the subsurface safety valve 18. However, it may be more economical to use the sidepocket mandrel 16 and valve 24. However, the sole use of the valve 70 provides the advantages of (1) an economical concept for a disaster solution, (2) it may be solenoid operated if desired, and (3) the lockout valve connot be reopened from the surface through the control line, but can be reopened and reset with wireline tools in the bore of the production tubing.

The present invention, therefore, is well adapted to carry out the objects and attain the ends and advantages mentioned as well as others inherent therein. While presently preferred embodiments of the invention have been given for the purpose of disclosure, numerous changes in the details of construction, arrangement of parts, and steps of the method, will be readily apparent to those skilled in the art and which are encompassed within the spirit of the invention and the scope of the appended claims.

What is claimed is:

1. A method of locking closed a subsurface actuated safety system in a well production tubing from the well surface comprising, releasably holding the subsurface safety system in the open position allowing well production through the production tubing, closing the subsurface safety system from the well surface through a control line extending from the safety system to the well surface exteriorly of the bore of the production tubing, and preventing the safety system from being opened through the control line, said control line is a hydraulic control line and including the step of venting the hydraulic control line at a subsurface location.

2. A method of locking closed a subsurface actuated safety system in a well production tubing from the well surface comprising, releasably holding the subsurface safety system in the open position allowing well production through the production tubing, closing the subsurface safety system from the well surface through a control line extending from the safety system to the well surface exteriorly of the bore of the production tubing, and preventing the safety system from being opened through the control line, wherein the step of preventing the safety system from being opened includes, mechanically locking the safety system in the closed position inside of the production tubing.

3. A subsurface controlled lock closed subsurface safety system comprising, a subsurface safety system in an well production tubing controlling the flow of well fluids through the tubing, a control line extending from the well surface to the safety system exteriorly of the production tubing for controlling the opening and closing of the safety system, and subsurface means connected to the control line and actuated by the control line for preventing the safety system from being opened by the control line.

4. The system of claim 3 wherein the system includes a hydraulically actuated subsurface safety valve actuated through a hydraulic control line and including, normally closed vent means connected to the control line, said vent means being actuated to the open position venting the control line upon the actuation by a higher hydraulic pressure in the control line than required for actuation of the safety valve.

5. The system of claim 3 wherein the system includes, a hydraulically actuated subsurface safety valve positioned in the production tubing, a hydraulic control line connected to the safety valve, a sidepocket mandrel connected in the production tubing above the safety valve, a normally closed valve positioned in the sidepocket mandrel and connected to the control line and actuated to an open position venting the control line upon the application of a predetermined pressure in the control line.

6. A subsurface well safety valve comprising, a housing having a bore therethrough, a valve closure member in the bore moving between open and closed positions for controlling the fluid flow through the bore, a flow tube telescopically movable in the housing for controlling the movement of the valve closure member, biasing means in the housing urgin the flow tube in a direction to close the valve, releasable latch means in the housing releasably holding the flow tube in a position holding the valve in the open position, and actuating means in the housing adapted to be connected to a control line extending to the well surface, said actuating means engagable with the releasable latch means for releasing the flow tube and closing the valve.

7. The safety valve of claim 6 wherein the actuating means is a hydraulic piston and cylinder assembly.

8. The safety valve of claim 6 wherein the releasable latch means includes, dog means engaging and preventing movement of the flow tube, shoulder means releasably holding the dogs in engagement with the flow tube, and spring means yieldably acting on the shoulder means.

9. A method of locking closed and opening a surface actuated safety system in a well production tubing from the well surface comprising, releasably holding the subsurface safety system in the open position allowing well production through the production tubing, closing the subsurface safety system from the well surface through a control line extending from the safety system to the well surface exteriorly of the bore of the production tubing, preventing the safety system from being opened through the control line, and when desired to open the subsurface system, lowering a wireline tool through the production tubing to the subsurface safety system and resetting the subsurface safety system with the lowered tool.

* * * * *

UNITED STATES PATENT AND TRADEMARK OFFICE

CERTIFICATE OF CORRECTION

PATENT NO. : 5,165,480

DATED : Nov. 24, 1992

INVENTOR(S) : Danny W. Wagoner et al.

It is certified that error appears in the above-indentified patent and that said Letters Patent is hereby corrected as shown below:

Column 7, line 7, delete "urgin" and replace it with --urging--.

Signed and Sealed this

Second Day of November, 1993

*Attest:*

*Attesting Officer*

BRUCE LEHMAN

*Commissioner of Patents and Trademarks*